US008476998B2

(12) United States Patent
Ramirez et al.

(10) Patent No.: US 8,476,998 B2
(45) Date of Patent: Jul. 2, 2013

(54) ELECTROMAGNETIC TRIP DEVICE FOR AN ELECTRIC SWITCH APPARATUS, ELECTRIC SWITCH APPARATUS COMPRISING ONE SUCH TRIP DEVICE

(75) Inventors: Jean Claude Ramirez, Saint Martin d'Uriage (FR); Pierre Bussieres, La Tour du Pin (FR); Bernard Loiacono, Seyssinet (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 139 days.

(21) Appl. No.: 13/067,459

(22) Filed: Jun. 2, 2011

(65) Prior Publication Data

US 2012/0001708 A1 Jan. 5, 2012

(30) Foreign Application Priority Data

Jul. 2, 2010 (FR) ..... 10 02799

(51) Int. Cl.
*H01H 9/00* (2006.01)

(52) U.S. Cl.
USPC ..... 335/172; 335/174; 335/175

(58) Field of Classification Search
USPC ..... 335/6, 9, 10, 21–46, 167–176, 255–264, 335/270, 278–281, 286
See application file for complete search history.

(56) References Cited

U.S. PATENT DOCUMENTS

| | | | | |
|---|---|---|---|---|
| 1,391,469 | A | 9/1921 | Getchell | |
| 4,698,609 | A * | 10/1987 | Goehle et al. | 335/255 |
| 5,894,257 | A * | 4/1999 | Roger et al. | 335/172 |
| 6,577,217 | B1 | 6/2003 | Bournarie et al. | 335/282 |
| 7,570,140 | B2 * | 8/2009 | Helms et al. | 335/172 |
| 2005/0219023 | A1 | 10/2005 | Garcia et al. | 335/220 |

FOREIGN PATENT DOCUMENTS

| | | |
|---|---|---|
| EP | 0 501 844 | 9/1992 |

* cited by examiner

*Primary Examiner* — Bernard Rojas
(74) *Attorney, Agent, or Firm* — Steptoe & Johnson LLP

(57) ABSTRACT

An electromagnetic trip device comprising a shell and a moving core sliding due to the action of a coil, the shell comprising a radial surface having an opening through which the moving core passes, superposition of a radial crown of the moving core and the radial surface forming a magnetic flux transfer surface enabling flow of an axial magnetic flux. The trip device comprises intercalary adjustment means of said transfer surface respectively positioned between the moving core and the opening, said intercalary adjustment means comprising two calibrated elements adjoined surface against surface and being respectively formed by an alternation of magnetic sectors and non-magnetic sectors; movement of a calibrated element with respect to the other enabling a variation of said transfer surface to be obtained.

12 Claims, 6 Drawing Sheets

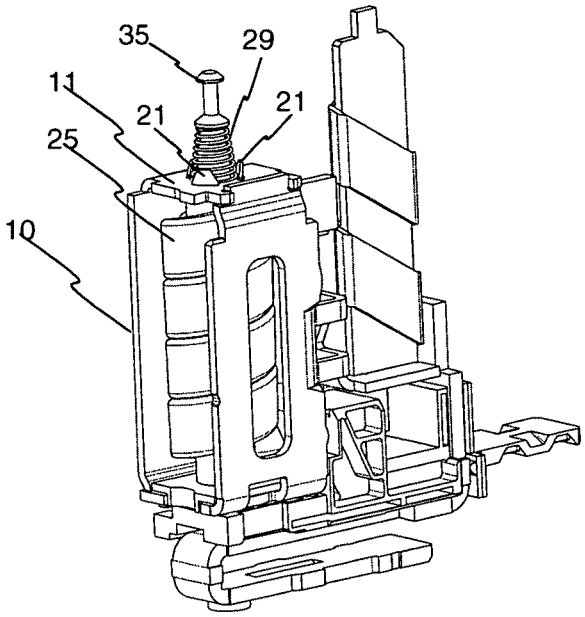
Fig. 1 (State of the Art)
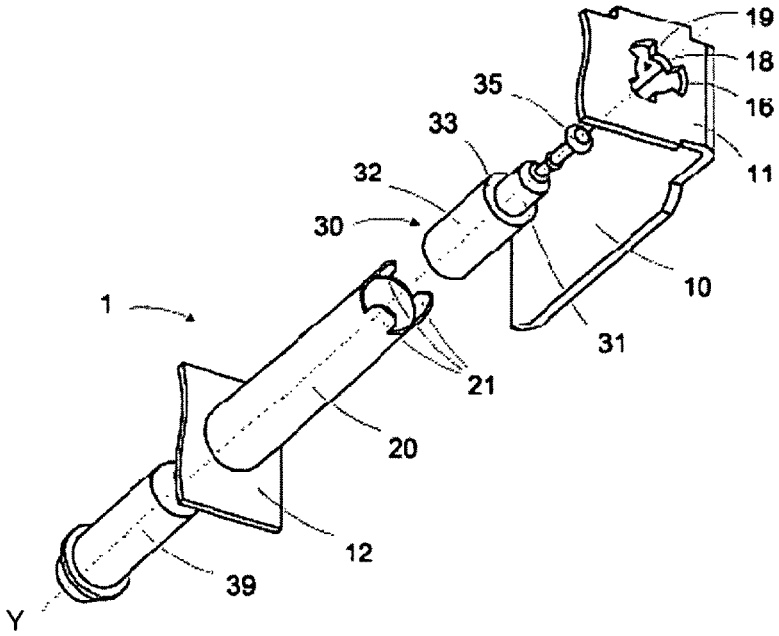
Fig. 2 (State of the Art)

ELECTROMAGNETIC TRIP DEVICE FOR AN ELECTRIC SWITCH APPARATUS, ELECTRIC SWITCH APPARATUS COMPRISING ONE SUCH TRIP DEVICE

BACKGROUND OF THE INVENTION

The present invention relates to an electromagnetic trip device for an electric switch apparatus comprising a magnetic circuit formed by a shell, a fixed core and a moving core sliding due to the action of a coil. The moving core has a radial crown separating a first part and a second part of different radial cross-sections, the shell comprising a radial surface having an opening through which the first part of the moving core passes. Superposition of the radial crown of the moving core and of the radial surface of the shell, in a rest position, forms a magnetic flux transfer surface enabling the flow of an axial magnetic flux.

The present invention also relates to an electric protective switch apparatus provided with at least one movable contact operating in conjunction with at least one stationary contact.

STATE OF THE ART

The use of an electromagnetic trip device in electric protective switch apparatuses is described in particular in the documents FR2779567 and EP0501844. The role of the electromagnetic trip devices is to open the electric contacts of a switch apparatus quickly in the event of an electric overload, typically when the current increases and exceeds a preset magnetic tripping threshold, for example thirteen times the rated current. For this, they comprise an electromagnet, sometimes called striker, through the coil of which the current to be monitored flows. The moving core of the striker stores energy progressively as the ampere-turns increase in the coil then, when the current exceeds the tripping threshold, suddenly releases this energy so as to be able to separate the movable contacts from the stationary contacts of the apparatus efficiently and rapidly.

The drawback of existing devices is that the magnetic tripping threshold level is generally difficult to adjust and to reproduce from one apparatus to the other, whereas the value of this threshold is obviously important for the apparatus to be able to guarantee safety of equipment and of persons. To obtain a reliable and reproducible tripping threshold, the manufacturing tolerances have to be reduced to preserve a great precision of dimensions and of the magnetic sticking areas between stationary and movable elements, possibly requiring rectification, which penalizes manufacturing and the cost of such sub-assemblies. In some apparatuses, thin insulating air-gap shims have to be added. It is also difficult in these devices to centre the moving core correctly over the whole of its travel without implementing sophisticated guiding to minimize clearances.

The solution described in European Patent Application EP1583130 filed by the applicant has the object of finding a simple and economic solution on the one hand enabling the moving core of the striker to be guided efficiently to ensure that the latter slides well throughout its travel while at the same time keeping its precise positioning with respect to the stationary elements such as the striker shell. It is a further object of the invention to provide the possibility of adjusting the magnetic tripping threshold easily for a given current rating while circumventing the disparities in the dimensions of the different parts and without the necessity of adding additional elements such as air-gap rings in particular. The solution also avoids complexification of manufacture of the parts, in particular the shape of the moving core. As represented in FIGS. 1 and 2, the electromagnetic trip device comprises a magnetic circuit formed by a shell 10, a fixed core 39 and a moving core 30 sliding along a longitudinal axis Y inside an insulating sheath 20 between a tripped position and a rest position due to the action of an induction coil 25 arranged around the sheath 20. The moving core 30 has a radial crown 33 separating a first part 31 and a second part 32 of different radial cross-section. The shell 10 comprises a radial surface 11 substantially perpendicular to the axis Y with an opening centred 19 on the axis Y through which the first part 31 of the moving core 30 passes. As represented in FIG. 1, said opening 19 comprises a serrated periphery composed of a plurality of teeth 17 directed towards the axis Y, and recessed areas 15 situated between each tooth accommodating an end of the insulating sheath. According to one feature, superposition of the radial crown 33 of the moving core 31 and the teeth 17 of the opening 19 of the radial surface 11 forms a flux transfer surface, in the rest position, enabling flow of an axial magnetic flux. Furthermore, a fixed radial air-gap exists between a front edge of each tooth and the first part of the moving core, enabling flow of a radial magnetic flux.

The solution of Patent application EP1583130 filed by the applicant proposes a design whereby the value of the tripping threshold of the moving core can be adjusted at manufacturing stage. However, too great dispersions in the chain of dimensions added to the variations of the forces of the springs at the time assembly of the different parts of the trip device is performed can lead to large variations of the length of the air-gap with respect to a nominal value calculated for a protective switch rating. The electric apparatuses presenting a fault subsequent to assembly are scrapped, which can result in an economic loss.

SUMMARY OF THE INVENTION

The object of the invention is therefore to remedy the shortcomings of the state of the art so as to propose a protective switch incorporating a magneto-thermal sub-assembly with adjustable tripping.

The electromagnetic trip device according to the invention comprises intercalary means for adjusting said flux transfer surface positioned between the moving core and the radial surface of the shell, said intercalary means for adjusting comprising two calibrated elements adjoined surface against surface and being respectively formed by an alternation of magnetic sectors and non-magnetic sectors. Movement of a first calibrated element with respect to a second calibrated element enables a variation of the magnetic flux transfer surface to be obtained.

According to a mode of development of the invention, a first calibrated element is integrated in the radial surface of the shell at the level of the opening comprising a serrated periphery composed of a plurality of teeth and recessed areas situated between each tooth. A second calibrated element is positioned between the moving core and the shell, movement of said second calibrated element enabling the variation of the magnetic flux transfer surface between the core and shell to be obtained via the magnetic sectors of the first calibrated element positioned in contact with the magnetic sectors of the second calibrated element.

The recessed areas situated between each tooth preferably accommodate one end of an insulating sheath, said end of the sheath comprising a plurality of axial protuberances secured by jamming in the recessed areas of the opening.

According to a mode of development of the invention, a first calibrated element is integrated in the radial crown of the moving core, a second calibrated element being positioned between the moving core and the shell, movement of one of the two calibrated elements with magnetic sectors enabling variation of the magnetic flux transfer surface between the core and the shell to be obtained via the magnetic sectors of the first calibrated element positioned in contact with the magnetic sectors of the second calibrated element.

The radial crown preferably comprises a plurality of teeth, recessed areas being situated between each tooth.

The second calibrated element is preferably integrated in the radial surface of the shell at the level of the opening comprising a serrated periphery composed of a plurality of teeth, recessed areas being situated between each tooth.

The recessed areas situated between each tooth advantageously accommodate one end of an insulating sheath, said end of the sheath comprising a plurality of axial protuberances secured by jamming in the recessed areas of the opening.

According to a particular embodiment, the intercalary means for adjusting includes axially extending legs for blocking the first circular calibrated element with respect to a second circular calibrated element.

All the magnetic sectors preferably have equal surfaces, the magnetic sectors having the same surface as the non-magnetic sectors.

The electric switch apparatus according to the invention comprises an electromagnetic trip device as defined above acting on the movable contact or contacts.

BRIEF DESCRIPTION OF THE DRAWINGS

Other advantages and features will become more clearly apparent from the following description of particular embodiments of the invention given as non-restrictive examples only and represented in the appended figures in which:

FIG. 1 represents a perspective view of an electromagnetic trip device according to a known embodiment;

FIG. 2 represents an exploded perspective view of a magnetic sub-assembly of an electromagnetic trip device according to FIG. 1;

DETAILED DESCRIPTION OF AN EMBODIMENT

Figure 5:
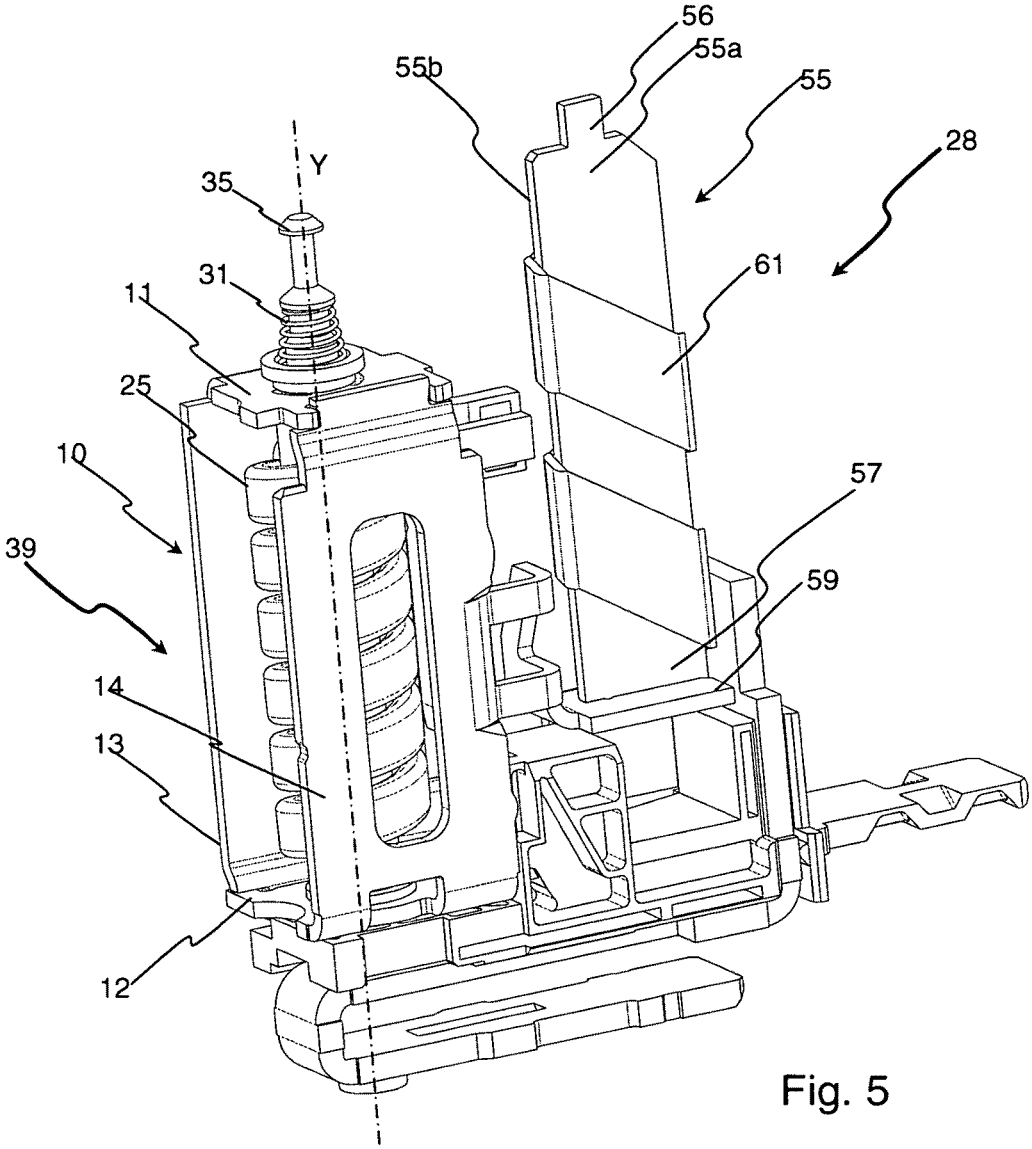
FIG. 5 represents a perspective view of an electromagnetic trip device according to a first embodiment of the invention.
Figure 6:
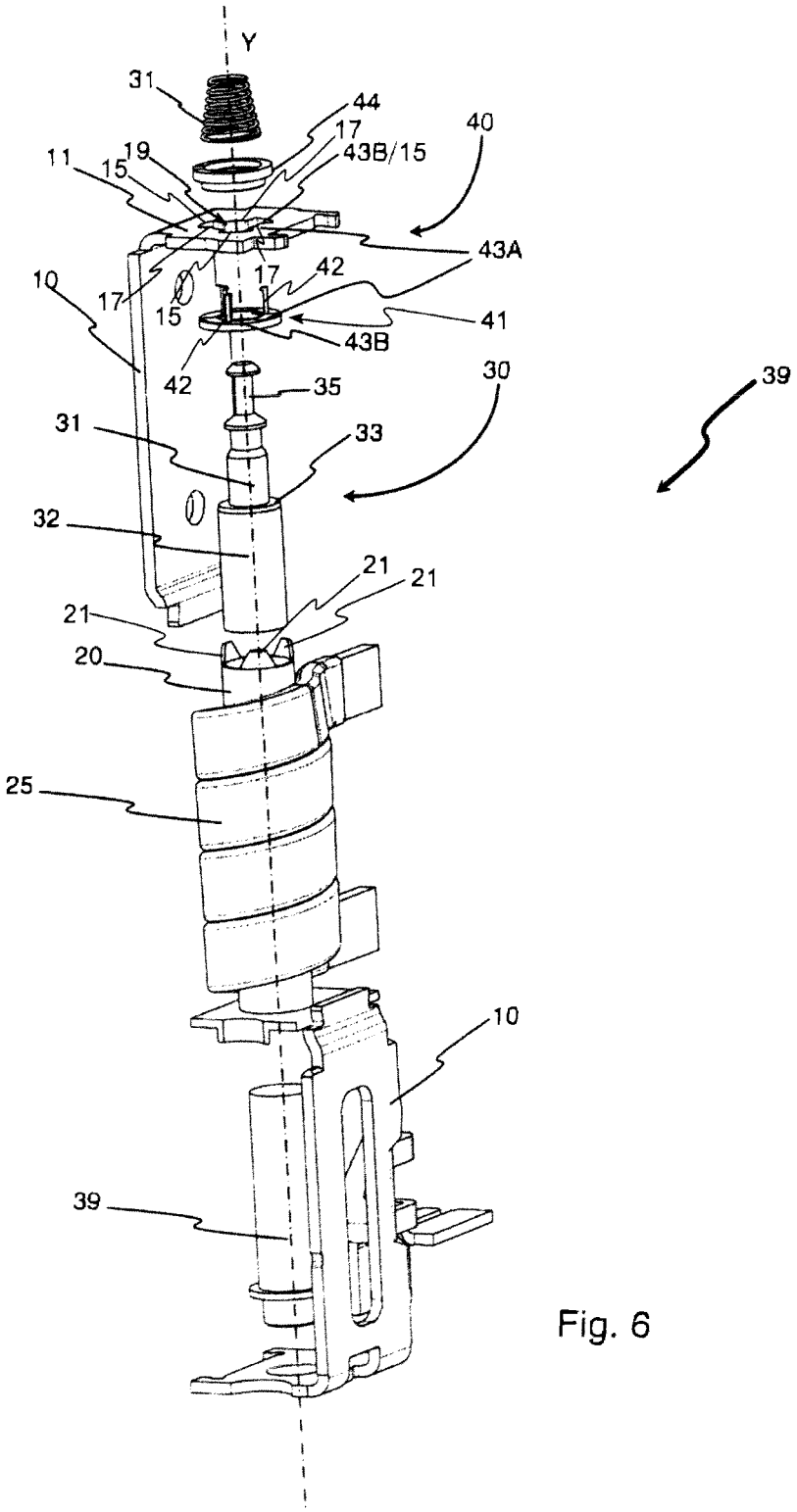
FIG. 6 represents an exploded perspective view of a magnetic sub-assembly of an electromagnetic trip device according to FIG. 5.
Figure 7:
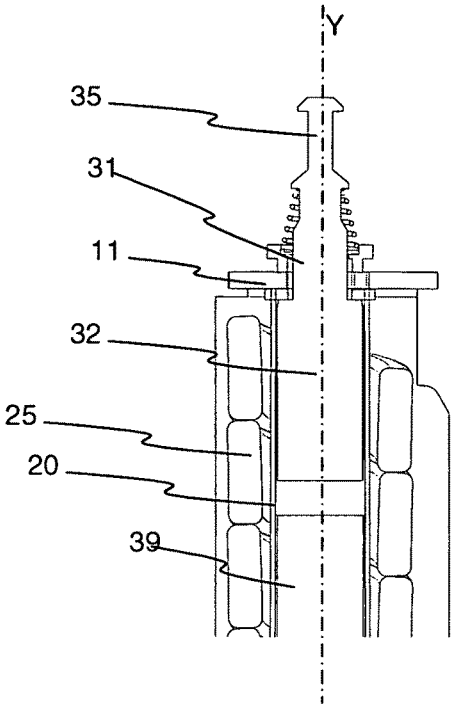
FIG. 7 represents a cross-sectional view of a magnetic sub-assembly of an electromagnetic trip device according to FIG. 5.

With reference to FIGS. 5 and 6, an electromagnetic trip device is designed to monitor a power current flowing in a switch apparatus and to trip abruptly when this current exceeds a certain threshold, called tripping threshold.

As represented in FIG. 6, the electromagnetic trip device 39 with striker comprises a magnetic circuit composed of a magnetic shell 10, a fixed core 39 and a moving core 30 that are made from ferromagnetic material. The fixed core 39 and moving core 30 are aligned along a longitudinal axis Y.

Figure 3:
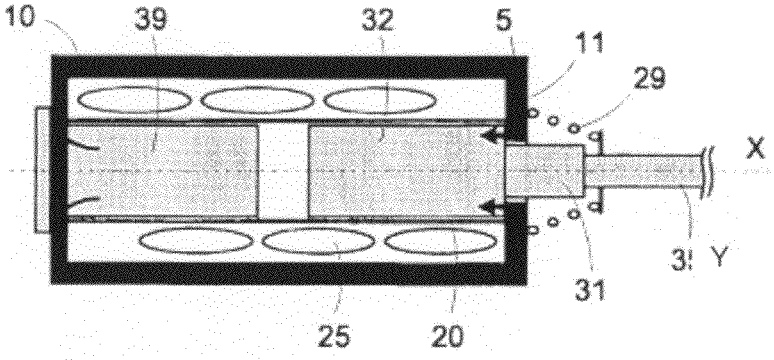
FIGS. 3 and 4 schematize in simplified manner an example of a magnetic sub-assembly in an axial (or longitudinal) view, respectively in the rest position and in the tripped position.
Figure 4:
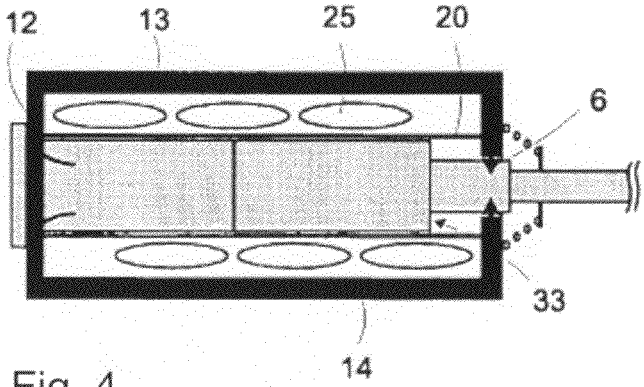

According to one embodiment, the two cores are preferably surrounded by an insulating cylindrical sheath 20. The moving core 30 preferably slides inside this insulating sheath 20 along the longitudinal axis Y between a rest position schematized in FIG. 3 and a tripped position schematized in FIG. 4. The moving core 30 moves due to the action of an induction coil 25 arranged around the insulating sheath 20. When the intensity of the current to be monitored flowing in the coil 25 exceeds the tripping threshold, the moving core then moves rapidly from the rest position to the tripped position. If the current in the coil 25 disappears, a return device, such as a return spring, returns the moving core 30 to its rest position. The moving core is composed of a first part 31 and a second part 32 juxtaposed in the direction of the fixed core 39.

In the preferred embodiment, the first and second parts 31, 32 are cylindrical. The cylindrical first and second parts 31, 32 have a different radial cross-section, i.e. the diameter of part 31 is smaller than that of part 32. The diameter of the second part 32 is substantially equal to that of the fixed core 39. Parts 31 and 32 are therefore separated by a rim of part 32 which thus forms a radial crown 33.

The moving core 30 thus has a radial crown 33 separating a first part 31 and a second part 32 of different radial cross-section. The shell 10 comprises a radial surface 11 substantially perpendicular to the axis Y with an opening 19 centred on the axis Y through which the first part 31 of the moving core 30 passes. Superposition, at the level of the opening 19, of the radial crown 33 of the moving core 30 and the radial surface 11 of the shell 10, in the rest position, forms a magnetic flux transfer surface enabling the flow of an axial magnetic flux 5.

The diameter of the second part 32 is preferably adjusted to be able to just slide inside the cylindrical sheath 20 without creating any clearance.

In known manner in this type of sub-assembly, the moving core 30 also comprises a striker member 35, for example in the extension of the first part 31, the purpose of which striker is to transmit movement of the moving core to the movable contact(s) of the switch apparatus in order to separate the latter from the corresponding stationary contact(s) when the moving core 30 moves to the tripped position.

The magnetic shell 10 as represented in FIG. 5 forms a substantially rectangular frame, surrounding the coil 25 and sheath 20, composed of two longitudinal planes 13, 14 substantially parallel to the axis Y, surrounded by two radial surfaces 11, 12 substantially perpendicular to the axis Y. The fixed core 39 is fixed to one of the radial surfaces 12. The other radial surface 11 has a radial opening 19 centred on the axis Y through which the first part 31 of the moving core 10 passes. The diameter of the second part 32 of the moving core is on the other hand sufficiently large to prevent it from passing through the opening 19.

Operation of a magnetic sub-assembly of magnetic striker type is as follows. In the absence of current in the coil 25, the moving core 30 is held by the small return spring 29 in the rest position (see FIG. 3), which moves it away from the fixed core 39. In this position, the radial crown 33 is pressed against the radial surface 11 of the shell 10, thereby creating the magnetic flux transfer surface. When a current starts to flow in the coil 25, a magnetic field is created flowing from the fixed core 39 to the shell 12, 13, 14, 11 then preferably flowing from the radial surface 11 directly to the radial crown 33 in the axial direction, as represented by the arrows 5 of FIG. 3. In the rest position, the axial air-gap existing between the radial surface 11 and the radial crown 33 is in fact smaller than the fixed radial air-gap between the radial surface 11 and the circumference of the first part 31 of the moving core 30. The moving core 30 is therefore subjected to an attraction force towards the fixed core 39 but also to an opposing retaining force directed towards the radial surface 11 of the magnetic shell. So long as the current to be monitored remains weak, the retaining force is preponderant and the moving core 30 remains substantially immobile, the axial air-gap always being smaller than the radial air-gap.

As the amperes-turns created by the coil 25 progressively increase, the magnetic flux transfer surface will become saturated and the attraction force will then increase faster than the retaining force. An increasingly large axial air-gap will appear at this location at the time the moving core 30 starts its movement in the direction of the fixed core 39 (which corresponds to an instantaneous current in the top coil at the defined tripping threshold). The magnetic field will then preferably flow from the radial surface 11 to the first part 31 of the moving core 30 in the radial direction, as represented by the arrows 6 of FIG. 4. The retaining force will then abruptly tend to zero and the moving core will be driven very quickly by the attraction force to strike the fixed core 39, practically without any resistance other than that of the return spring 39 of very low resistant force value.

According to an embodiment of the invention, the electromagnetic trip device 39 comprises means for adjusting the magnetic tripping threshold via adjustment of the magnetic flux transfer surface enabling flow of an axial magnetic flux 5. The electromagnetic trip device comprises intercalary adjustment means 40, 41 of said magnetic flux transfer surface respectively positioned between the moving core 30 and opening 19. Superposition of the radial crown 33 of the moving core 30, of the intercalary adjustment means 40, 41 and of the radial surface 11 of the shell 10 forms the radial flux surface transfer in the rest position.

Said intercalary adjustment means 40, 41 comprise two calibrated elements 40 and 41 adjoined surface against surface.

As an exemplary embodiment, the two calibrated elements 40, 41 are circular and comprise an axis of revolution that is the same as the longitudinal axis Y.

Each calibrated element 40, 41 is respectively formed by an alternation of magnetic sectors 43A and non-magnetic sectors 43B. Movement of a first calibrated element with respect to a second calibrated element makes the radial magnetic flux transfer surface between the shell 10 and moving core 30 vary. In other words, setting a calibrated element in motion with respect to another calibrated element enables the reluctance of the magnetic circuit to be adjusted thereby enabling the retaining force of the moving core 30 to be adjusted. This then enables the desired magnetic threshold to be set.

According to a first embodiment of the invention, a first calibrated element 40 is integrated in the radial surface 11 of the shell 10 at the level of the opening 19.

As identified in FIG. 2, and as shown again in FIG. 6, the radial opening 19 comprises a serrated inner periphery formed by a plurality N of teeth 17 directed towards the longitudinal axis Y, arranged staggered on this periphery. Recessed areas 15 are then situated between each tooth 17. Each tooth 17 then acts as a magnetic sector 43A and each recessed area 15 the acts as a non-magnetic sector 43B.

Figure 8A:
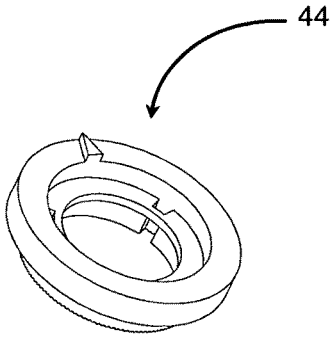
FIGS. 8A and 8B represent detailed views of the intercalary adjustment means of the flux transfer surface of a magnetic sub-assembly of an electro-magnetic trip device according to FIG. 5.
Figure 8B:
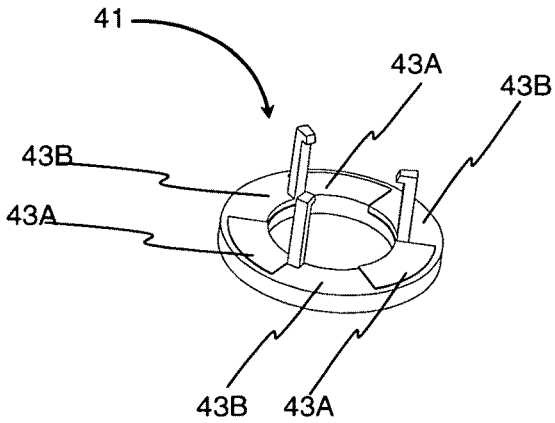

The second calibrated element 41 is then positioned between the moving core 30 and the shell 10. As represented in FIG. 8B, the second calibrated element 41 is preferably circular and is preferably composed of a washer designed to be positioned on the radial crown 33 of the moving core 30. The washer is then composed of an alternation of N magnetic sectors 43A and N non-magnetic sectors 43B. Rotation of said second calibrated element with magnetic sectors enables a variation of the magnetic flux transfer surface between the core 30 and shell 10 to be obtained via the magnetic sectors 43A of the first calibrated element positioned in contact with the magnetic sectors 43A of the second calibrated element.

According to this development, the recessed areas 15 situated between each tooth 17 accommodate an end of the insulating sheath 20, said end of the sheath 20 comprising a plurality N of axial protuberances 21 secured by jamming in the recessed areas 15 of the opening 19.

The dimensions of the teeth 17 are designed so that the first part 31 of the moving core 30 can pass freely through the opening 19 in the inner space situated between the teeth 17, but so that the teeth 17 can on the other hand retain the second part 32. When the moving core 30 is in the rest position, the radial crown 33 is therefore pressed against the teeth 17, thereby creating a very small axial air-gap.

The flux transfer surface is discontinuous on account of the serrated periphery of the opening 19, which avoids having a too large retaining force applied to the moving core 30 by the axial magnetic flux 5. This discontinuity will moreover enable the retaining force to be adjusted very simply. In particular, by simply adjusting the width of the teeth 17, it is then possible to modify the flux transfer surface and therefore to easily adjust the tripping threshold of the sub-assembly 1, without modifying any other dimensions or features, in particular without having to modify and complexify the shape of the moving core with bores or grooves on the radial crown 33, which would give rise to additional costs in manufacture of such a part. Furthermore, this avoids having to add additional shims or rings of great precision to increase the axial air-gap between the radial crown 33 and the teeth 17.

The teeth 17 each present a front edge 18 directed towards the longitudinal axis Y and having a shape that is preferably complementary to the periphery of the first part 31 of the moving core 30, which is in the shape of an arc of a circle. For correct operation of the sub-assembly 1, the radial air-gaps existing between the front edge 18 of the different teeth 17 and the periphery of the first part 31 have to remain constant. Furthermore, axial movement of the moving core 30 must not be disturbed by jamming or suchlike, for the striker member 35 to act efficiently. Centring of the moving core 30 over its whole travel along the longitudinal axis Y is therefore crucial. It is achieved by guiding of the insulating sheath 20 which surrounds the second part 32 of the moving core 30 snugly. However, this centring is difficult as it requires the two ends of the insulating sheath 20 to be firmly secured with respect to the magnetic shell 10. A first end of the insulating sheath 20 is easily fixed to the radial surface 12. According to the invention, the other opposite end of the insulating sheath 20 is advantageously serrated by means of a plurality of N protuberances 21 which extend the insulating sheath in an axial direction X. These protuberances 21 engage in the N recessed areas 15 situated between the teeth 17 and are held there for example by simple jamming. Each recessed area 15 comprises a rear wall 16 directed towards the longitudinal axis Y. The dimension of the recessed areas 15 are designed such that the protuberances 21 are thus pressed against the rear wall 16 preventing any radial movement of the sheath 20. This simple device enables the insulating sheath to be kept perfectly well centred with respect to the longitudinal axis Y and thus prevents variations of the radial air-gap and ensures good sliding of the moving core 30. It is then easier to guarantee a high reproducibility and good dependability of the performances of the magnetic sub-assembly 1.

According to the embodiment presented in FIG. 6, the number N of teeth 17 and of recessed areas 15 is equal to three. The three recessed areas 15 collaborate with three protuberances 21 of the sheath 20. The teeth 17 are regularly staggered around the longitudinal axis Y and are of equal width to balance the radial forces due to the radial magnetic flux 6 passing through the radial air-gaps and therefore to preserve centring of the first part 31 of the moving core 30 inside the opening 19. A number N different from three could also be envisaged, such as for example an opening 19 comprising two teeth 17 symmetrically opposite with respect to the longitudinal axis Y and two protuberances 21 also symmetric to the end of the sheath 20, as suggested by FIGS. 3 and 4. In another alternative embodiment, several teeth of different widths could also be had, associated with a positioning not regularly arranged around the longitudinal axis Y so as to nevertheless ensure a good balancing of the radial magnetic forces on the moving core.

Furthermore, the preferred embodiment describes a magnetic sub-assembly the insulating sheath, fixed core and moving core of which all have circular radial cross-sections. Other solutions could also be envisaged for these elements, such as for example radial cross-sections of substantially square shape. They would then be associated with an opening 19 also of a suitable square shape, presenting a serrated periphery with four teeth (one on each side of the square) on which the square radial crown of the moving core bears, the four teeth being surrounded by four recessed areas (in each corner of the square) collaborating with four prominences corresponding to the end of the insulating sheath.

According to an alternative development that is not represented, a first circular calibrated element 40 comprises a washer fitted inside the opening 19. The washer is then composed of an alternation of N magnetic sectors 43A and N non-magnetic sectors 43B.

Figure 9:
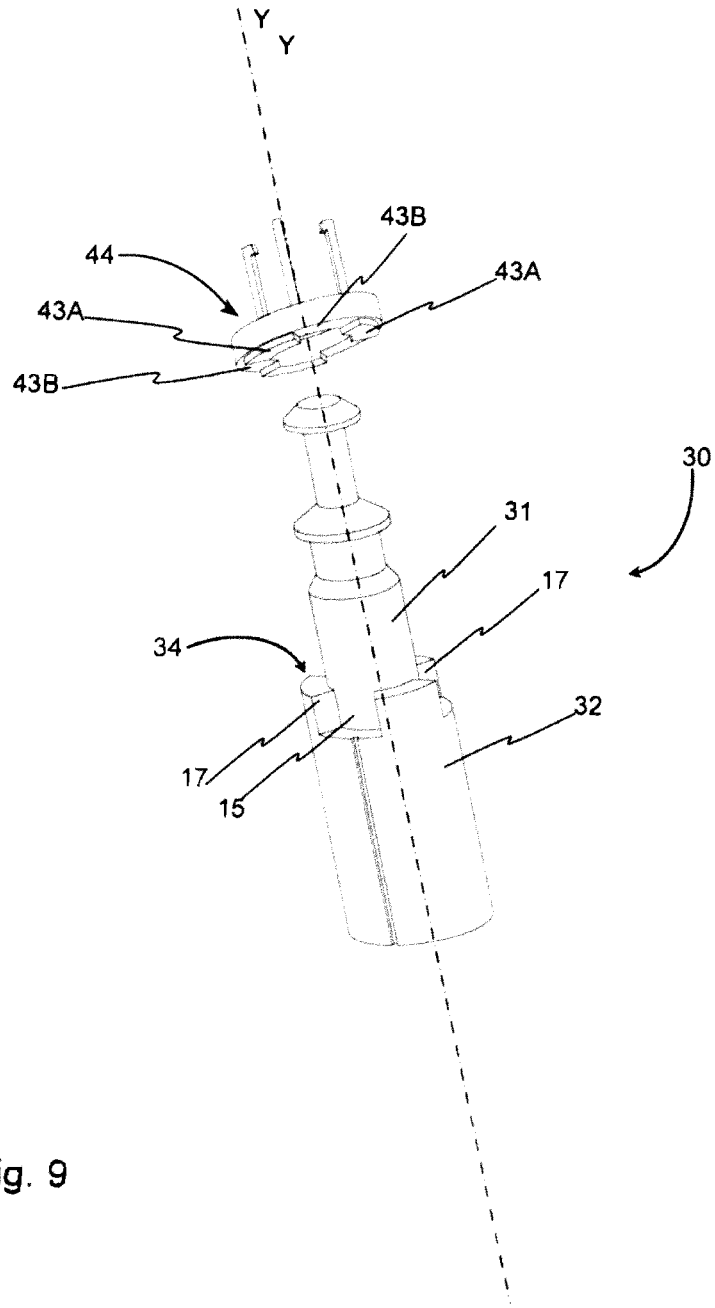
FIG. 9 represents a detailed perspective view of the intercalary adjustment means of the flux transfer surface of a magnetic sub-assembly of an electro-magnetic trip device according to a second embodiment of the invention.

According to another alternative embodiment of the invention as represented in FIG. 9, a first calibrated element is integrated in the radial crown 34 of the moving core 30. The radial crown 34 then comprises a plurality N of teeth 17 directed towards the longitudinal axis Y, arranged on the periphery of the crown. Recessed areas 15 are then situated between each tooth 17. Each tooth 17 then acts as a magnetic sector and each recessed area 15 then acts as a non-magnetic sector. As an exemplary embodiment of the first calibrated element 42, the teeth 17 can form an integral part of the first part 31 of the moving core 30. The core can for example be manufactured by cold stamping. According to an alternative embodiment that is not represented, the teeth 17 can form part of a washer designed to engage on the first part 31 of the moving core 30. The washer is then composed of an alternation of N magnetic sectors 43A and N non-magnetic sectors 43B.

The moving core 10 is preferably immobilized in rotation on its longitudinal axis Y to prevent the radial transfer surface from becoming mal-adjusted with time.

The second calibrated element 44 is preferably circular and is positioned between the moving core 30 and the shell 10. As an exemplary embodiment represented in FIG. 9, the second calibrated element 44 is preferably composed of a washer designed to be positioned between the radial crown 34 of the moving core 30 and the shell 10. The washer is then composed of an alternation of N magnetic sectors 43A and N non-magnetic sectors 43B.

According to a non-represented alternative embodiment of the second calibrated element, said second element is integrated in the radial surface 11 of the shell 10 at the level of the opening 19 comprising a serrated periphery composed of a plurality N of teeth 17 directed towards the longitudinal axis Y, and recessed areas 15 situated between each tooth 17. Rotation of the first calibrated element then enables a variation of the magnetic flux transfer surface between the sectors of the first circular calibrated element and the moving core to be obtained.

Movement, in particular rotation, of one of the two calibrated elements with magnetic sectors enables a variation of the magnetic flux transfer surface between the sectors of the first calibrated element and the moving core to be obtained via the second calibrated element.

According to the development modes of the invention, acting as exemplary embodiments, one of the calibrated elements is mobile and is associated with an adjustment knob 44. This device is achieved by assembling this calibrated and circular part on each side of the shell. Securing in a given position after rotation can be performed by crenellation or by tight friction. Rotation of the device can be achieved by a lever or a knob.

According to a development mode of the invention, all the magnetic sectors 43A have equal surfaces.

According to a development mode of the invention, the magnetic sectors 43A have the same surface as the non-magnetic sectors 43B.

As represented in FIG. 5, as an exemplary embodiment, the electromagnetic trip device 39 is associated with the thermal trip device 28 of a magnetothermal trip sub-assembly. The thermal trip device comprises a thin bimetal strip 55 of general elongate rectangular shape having a first free end 56 and a second end 57 assembled by any suitable fixing means on a support plate 59 of general rectangular shape made from electrically conductive material. As shown in FIG. 5, the bimetal strip 55 is arranged in such a way that its two opposite large side faces 55*a*, 55*b* are parallel along Y axis. The thermal trip device 28 also comprises a heater 61, here in the form of a strip, that is applied against the bimetal strip 55 via a suitable electric insulating means, in this instance a thin rectangular insulating sleeve surrounding the bimetal strip 55, approximately between the two ends 56, 57 of the latter. The heater 61 has a first end designed to be electrically connected to the conducting part supporting the stationary contact and a second end connected, for example by welding, to a particular point of the bimetal strip 55 situated close to the free end 56 of the latter. As an example of operation of the electric protective switch apparatus, starting from the closed position of the contacts, an electric overload detected by the bimetal strip 55 causes a deflection of the latter which actuates a trip bridge which drives an operating device which makes the electric contacts of the electric switch apparatus open.

According to an embodiment that is not represented, the electric switch apparatus according to the invention is provided with at least one movable contact operating in conjunction with at least one stationary contact, characterized in that it comprises an electromagnetic trip device as defined in the foregoing. Said trip device is able to act on the movable contact or contacts.

The invention claimed is:

1. An electromagnetic trip device for an electric switch apparatus, comprising a magnetic circuit formed by a shell, a fixed core and a moving core sliding due to the action of a coil, the moving core having a radial crown separating a first part and a second part of different radial cross-sections, the shell comprising a radial surface having an opening through which the first part of the moving core passes, superposition of the radial crown of the moving core and the radial surface of the shell forming, in a rest position, a magnetic flux transfer surface enabling flow of an axial magnetic flux, comprising intercalary adjustment means of said flux transfer surface positioned between the moving core and the radial surface of the shell, said intercalary adjustment means comprising two calibrated elements adjoined surface against surface and being respectively formed by an alternation of magnetic sectors and non-magnetic sectors, movement of a first calibrated element with respect to a second calibrated element enabling variation of the magnetic flux transfer surface to be obtained.

2. The electromagnetic trip device according to claim 1, wherein a first calibrated element is integrated with the radial surface of the shell at the level of the opening comprising a serrated periphery composed of a plurality of teeth and of recessed areas situated between each tooth, a second calibrated element being positioned between the moving core and the shell, movement of said second calibrated element enabling a variation of the magnetic flux transfer surface between the core and the shell to be obtained via the magnetic sectors of the first calibrated element positioned in contact with the magnetic sectors of the second calibrated element.

3. The electromagnetic trip device according to claim 2, wherein the recessed areas situated between each tooth accommodate one end of an insulating sheath, said end of the sheath comprising a plurality of axial protuberances secured by jamming in the recessed areas of the opening.

4. The electromagnetic trip device according to claim 1, wherein a first calibrated element is integrated in the radial crown of the moving core, a second calibrated element being positioned between the moving core and the shell, movement of one of the two calibrated elements with magnetic sectors enabling a variation of the magnetic flux transfer surface between the core and the shell to be obtained via the magnetic sectors of the first calibrated element positioned in contact with the magnetic sectors of the second calibrated element.

5. The electromagnetic trip device according to claim 4, wherein the radial crown comprises a plurality of teeth, recessed areas being situated between each tooth.

6. The electromagnetic trip device according to claim 4, wherein the second calibrated element is integrated in the radial surface of the shell at the level of the opening comprising a serrated periphery composed of a plurality of teeth, recessed areas being situated between each tooth.

7. The electromagnetic trip device according to claim 6, wherein the recessed areas situated between each tooth accommodate one end of an insulating sheath, said end of the sheath comprising a plurality of axial protuberances secured by jamming in the recessed areas of the opening.

8. The electromagnetic trip device according to claim 1, wherein the intercalary adjustment means comprise axially extending legs for blocking the first circular calibrated element with respect to a second circular calibrated element.

9. The electromagnetic trip device according to claim 1, wherein all the magnetic sectors have equal surfaces, the magnetic sectors having the same surface as the non-magnetic sectors.

10. An electric switch apparatus provided with at least one movable contact operating in conjunction with at least one stationary contact, comprising an electromagnetic trip device according to claim 1 acting on the movable contact or contacts.

11. An electric switch apparatus according to claim 10 wherein the intercalary adjustment axially extending legs comprise means for blocking the first circular calibrated element with respect to a second circular calibrated element.

12. An electric switch apparatus according to claim 11 wherein all the magnetic sectors have equal surfaces, the magnetic sectors having the same surface as the non-magnetic sectors.

* * * * *